US007063621B2

(12) United States Patent
Barry

(10) Patent No.: US 7,063,621 B2
(45) Date of Patent: Jun. 20, 2006

(54) REST FOR A SNOOKER CUE

(76) Inventor: Michael Roy Barry, 63 St. Oliver's Park, Ratoath, Co. Meath (IE)

( * ) Notice: Subject to any disclaimer, the term of this patent is extended or adjusted under 35 U.S.C. 154(b) by 0 days.

(21) Appl. No.: 10/680,080

(22) Filed: Oct. 6, 2003

(65) Prior Publication Data

US 2004/0266541 A1 Dec. 30, 2004

(30) Foreign Application Priority Data

Jun. 25, 2003 (IE) ..... S2003/0470

(51) Int. Cl.
*A63D 15/00* (2006.01)
*A63D 15/10* (2006.01)

(52) U.S. Cl. ..... 473/42; 473/2

(58) Field of Classification Search ..... 473/1, 473/2, 42–48

See application file for complete search history.

(56) References Cited

U.S. PATENT DOCUMENTS 774,862 A * 11/1904 Black ..... 473/42
990,098 A * 4/1911 Blackburn ..... 473/46
1,227,312 A * 5/1917 Rear ..... 473/42
2,805,068 A * 9/1957 Herzer ..... 273/129 R
2,832,598 A * 4/1958 Strub ..... 273/129 R
3,836,145 A * 9/1974 Frejd ..... 473/42
4,423,867 A * 1/1984 Wise ..... 473/44
6,267,686 B1 * 7/2001 Legacie, Jr. ..... 473/44
6,419,588 B1 * 7/2002 Watlack et al. ..... 473/42

FOREIGN PATENT DOCUMENTS

GB 2194161 A * 3/1988
GB 2196867 A * 5/1988
GB 2200562 A * 8/1988
GB 2323300 A * 9/1998
GB 2329845 A * 4/1999

* cited by examiner

*Primary Examiner*—Mitra Aryanpour
(74) *Attorney, Agent, or Firm*—Hogan & Hartson L.L.P.

(57) ABSTRACT

According to the invention there is provided a rest for a cue having an elongated shaft defining a central longitudinally extending shaft axis, a table engaging means, and an intermediate connecting means connecting the table engaging means with the shaft, the intermediate connecting means being shaped for avoiding an obstruction on the table adjacent a location where the table engaging means is to engage the table. There is further provided a means to restrain rotational movement of the intermediate connecting means about the shaft axis.

22 Claims, 8 Drawing Sheets

REST FOR A SNOOKER CUE

FIELD OF THE INVENTION

The present invention relates to a rest for a cue, for example, a snooker cue, a billiard cue, or the like.

BACKGROUND TO THE INVENTION

Rests for snooker and billiard cues are used in the game of snooker or billiards when the alignment of the cue ball with the ball to be next struck by the cue ball is in a position on the table which does not easily lend itself to cradling the cue on the hand of the player. In general, such cue rests comprise an elongated shaft which terminates in a table engaging member which is rested on the table, and a cue engaging member, typically extending upwardly from the table engaging member for cradling the cue. However, regularly the cue ball is obstructed by other balls which are in play on the table, and in such cases, the cue rest must be rested on the table with the table engaging member engaging the table some distance from the cue ball, or alternatively with the shaft of the cue rest extending from the surface of the table at a relatively large angle. This is disadvantageous, since the greater the angle the cue rest makes with the table, or the further the table engaging member, and in turn, the cue rest is displaced from the cue ball, the more difficult it is for a player to tightly control the striking action of the cue on the cue ball.

There is therefore a need for a cue rest which overcomes this problem.

A common variety of cue rest is the cross rest. In use, the cue is supported by the cue-engaging portion of the cue rest. The cue-engaging portion takes the form of a crosspiece, set perpendicular to the shaft of the cue rest. In use, the cue rest is laid upon the playing table with the ends of two of the arms of the crosspiece in contact with the playing surface and the other two arms pointing diagonally upwards. The end of the cue shaft is then supported in the angle created between the two uppermost arms of the crosspiece.

However, the current designs of crosspieces have associated drawbacks. Most cue shafts taper from a relatively thick handle portion to a thinner portion ending in the striking point. In order to take a shot, particularly with the application of force, the cue shaft is progressively pushed through the uppermost arms of the crosspiece. In doing so, as the shaft is fed through the angle, the diameter of the portion of the shaft in contact with the rest crosspiece increases. This results in the axis of the cue elevating as the striking point is brought into contact with the ball, resulting in decreased accuracy of contact. There therefore exists a need to overcome this drawback of cue-rests. It will be appreciated that the invention is suitable for similar games, for example, pool.

SUMMARY OF THE INVENTION

The present invention is directed towards providing a cue rest that overcomes the above problems. According to the invention there is provided a rest for a cue, the cue rest comprising an elongated shaft defining a central longitudinally extending shaft axis, a table engaging means, and an intermediate connecting means connecting the table engaging means with the shaft, the intermediate connecting means being shaped for avoiding an obstruction on the table adjacent a location where the table engaging means is to engage the table.

In one embodiment of the invention the intermediate connecting means extends between two spaced apart ends, one end being connected to the shaft, and the other end being connected to the table engaging means.

In another embodiment of the invention the two ends of the intermediate connecting means are aligned with each other and with the shaft axis.

In another embodiment of the invention the intermediate connecting means comprises an elongated intermediate connecting member extending between the shaft and the table engaging means.

In a further embodiment of the present invention the intermediate connecting member is of arcuate shape.

In a further embodiment of the present invention the intermediate connecting member is of half-bottle shape.

By half-bottle shape we mean shapes such as those of a typical Bordeaux or Burgundy wine bottle silhouette, halved along its central longitudinal axis. In essence, the bottle has a body, which narrows in a shoulder into a thin neck.

The term 'half-bottle shape' therefore defines a short horizontal line set substantially perpendicular to a longer vertical line, with the lines connected to each other at one end, with the vertical line extending into a curved line which terminates in a straight line set substantially parallel with the vertical line, that lies along the axis of a perpindicular line at the other end of the horizontal line.

Another way of considering the shape is to liken it to a front silluoette of a human head and torso, which has a slim neck region tapering into a shoulder and a body of broader width than the neck.

In a further embodiment of the invention a cue engaging means for cradling the cue extends from the table engaging means.

Preferably, the table engaging means is adjustably mounted to the intermediate connecting means, and preferably, is pivotally connected to the intermediate connecting means, and ideally is pivoted about the shaft axis.

In a further embodiment of the present invention, there is provided a means to restrain the rotational movement of the intermediate connecting means about the shaft axis.

In a further embodiment of the present invention, the table engaging means comprising two legs and the cue engaging means comprising two arms are arranged to form a cruciform structure, the arms defining angles therebetween.

In a further embodiment of the present invention, at least one of the table engaging means or cue engaging means houses a rotation restraining means.

In a further embodiment of the present invention the intermediate connecting means is connectable to the table engaging means by an axial bolt which is adapted for engaging with the rotation restraining means.

In a further aspect the present invention provides a rotation restraining means for a cue rest having a spring retainer, a compression spring engagable with the spring retainer, a spindle having two ends, one end being engagable with the compression spring and the other end being engagable with the axial bolt, wherein the axial bolt has a shaft body and a portion of the shaft body is adapted to engage with the spindle end, such that axial movement of the spindle, by rotation of the table engaging means about the shaft axis, causes compression of the spring, such that when the end of the spindle engages with the portion of the shaft body adapted to engage with the spindle end, the compression of the spring is relaxed to reversibly lock the relative position of the table engaging means to the intermediate connecting means.

In a further embodiment of the present invention the shaft body of the axial bolt comprises at least one flat surface.

In a further embodiment of the present invention the shaft body of the axial bolt comprises at least one indentation adapted to accommodate a shaped end of the spindle.

Preferably, the shaped end of the spindle is a protruding hemisphere or spherical cap.

In a further embodiment of the present invention the axial bolt is integrally formed with the intermediate connecting means. In such an embodiment, rotational movement of the intermediate connecting means about the axial bolt is avoided, and therefore relative rotational movement of the intermediate connecting means and the table engaging means can be more controllable.

In a further embodiment of the present invention there is provided a cue rest further comprising a cue support.

In a further embodiment of the present invention, the table engaging means comprising two legs and the cue engaging means comprising two arms are arranged to form a cruciform structure such that four angles are formed between the arms, and a cue support is locatable within at least one of the angles of the cruciform structure.

There is also provided a cue rest comprising an elongated shaft defining a central longitudinally extending shaft axis connected to a cruciform structure, wherein the cruciform structure comprises a table engaging means comprising two arms and a cue engaging means comprising two arms, wherein the two pairs of arms are arranged to form the cruciform structure, with four angles being formed between the arms, and a cue support is locatable within at least one of the angles of the cruciform structure.

In a further embodiment of the present invention the cue support is integrally formed with the cruciform structure.

In a further embodiment of the present invention the cue support is independently formed from the cruciform structure and is adapted to be mounted upon the cruciform structure.

There is also provided a cue supporting cradle for a cue adapted to be securably engagable within the angle of a cue rest comprising a cruciform structure such that the cradle supports the cue.

Alternatively, the cue supporting cradle for a cue is detachably mountable upon the cue rest.

BRIEF DESCRIPTION OF THE DRAWINGS

The invention will be more clearly understood from the following description of an embodiment thereof, which is given by way of example only, with reference to the accompanying drawings, in which.

DETAILED DESCRIPTION

Figure 1:
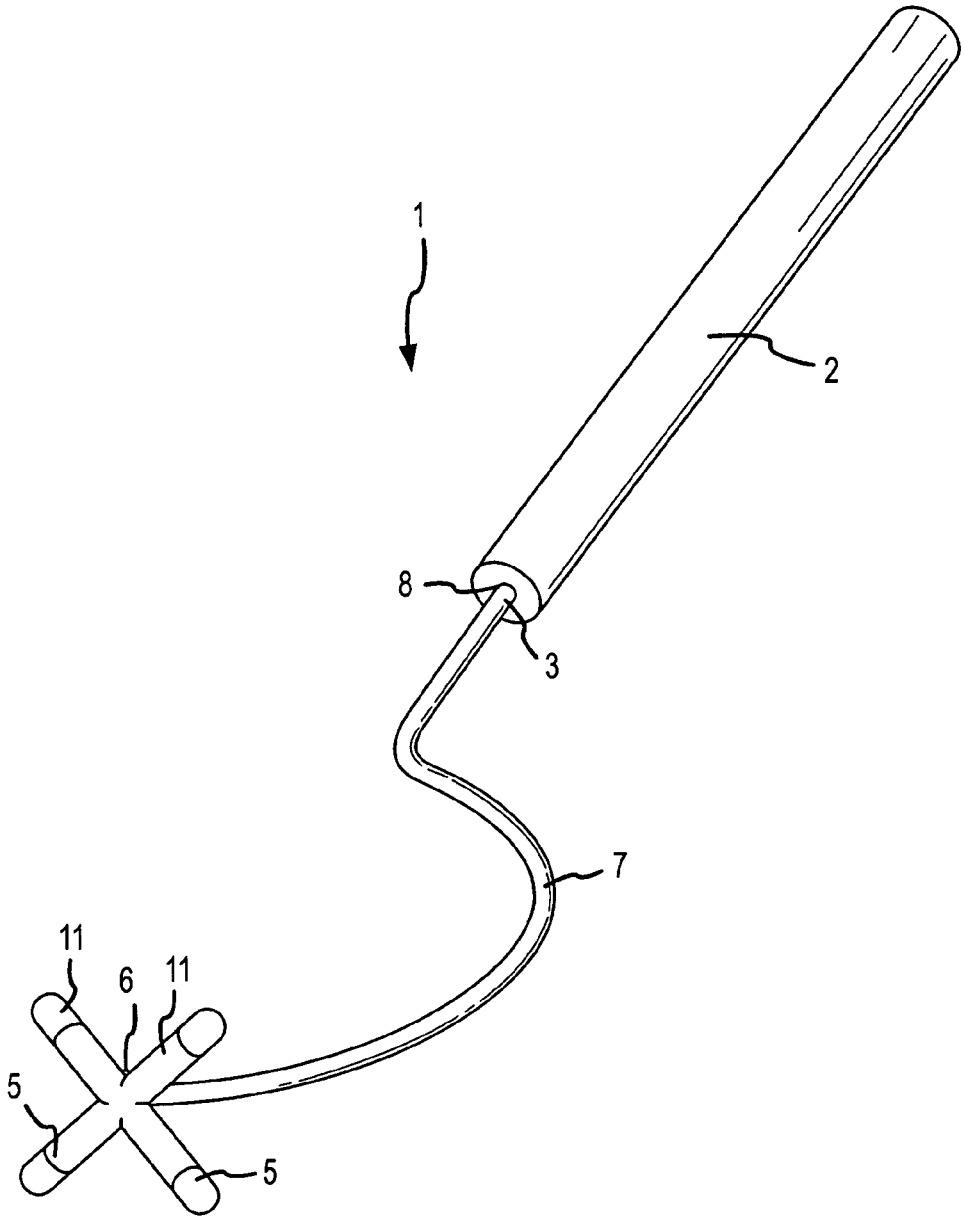
FIG. 1 is a perspective view of a cue rest according to the invention.
Figure 2:
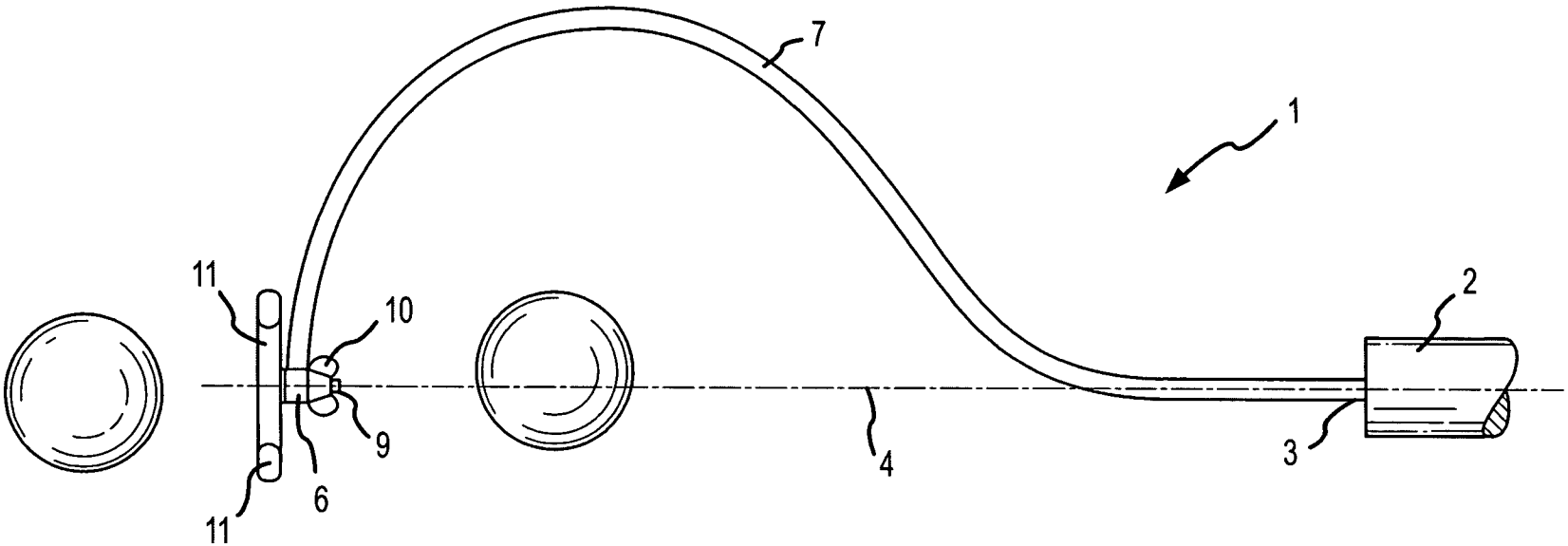
FIG. 2 is a plan view of a portion of the cue rest of FIG. 1.
Figures 3, 7:
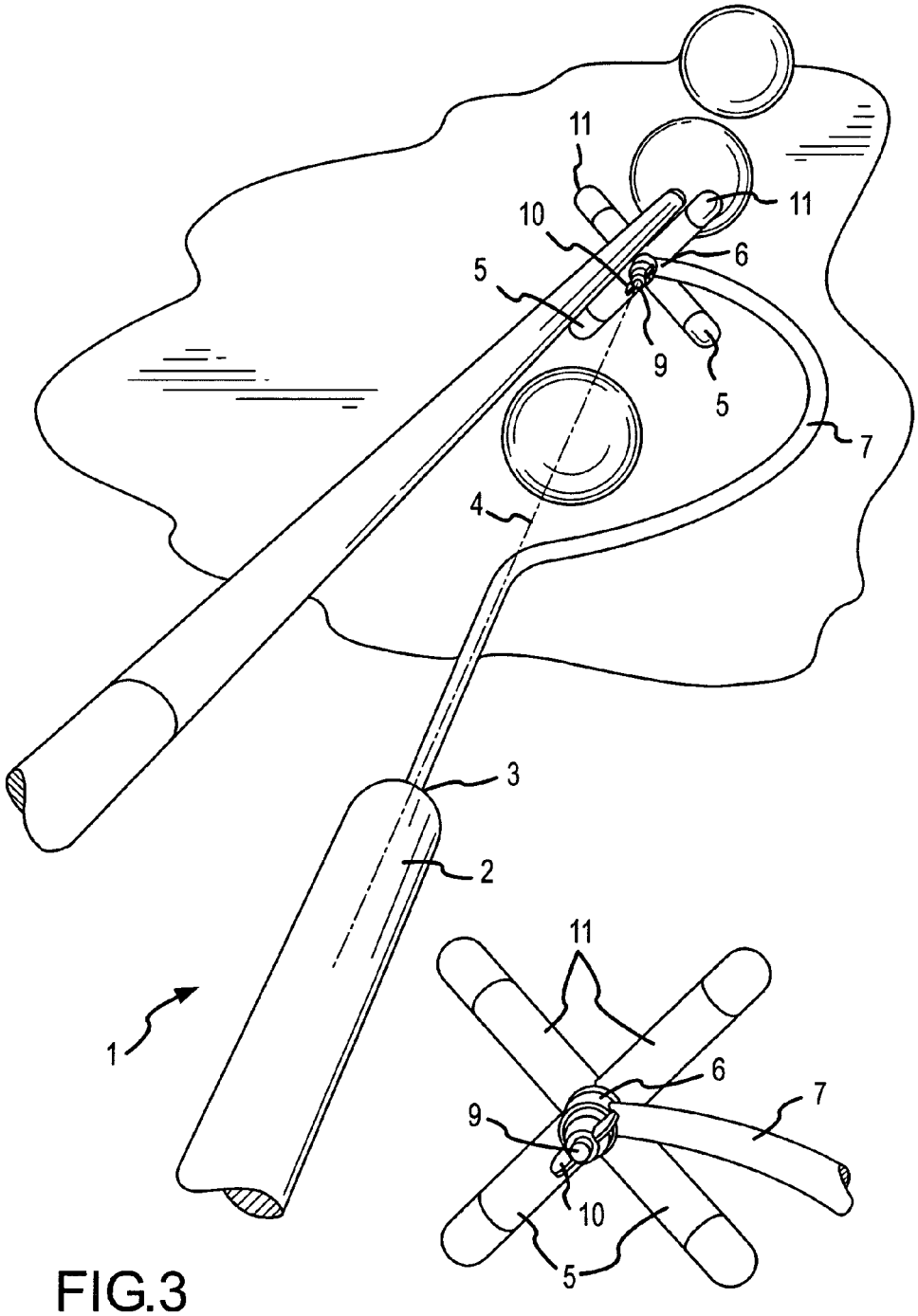
FIG. 3 is a perspective view of a portion of the cue rest of FIG. 1 in use.
FIG. 7 is a perspective view of a detail of the cue rest of FIG. 1.
Figure 4:
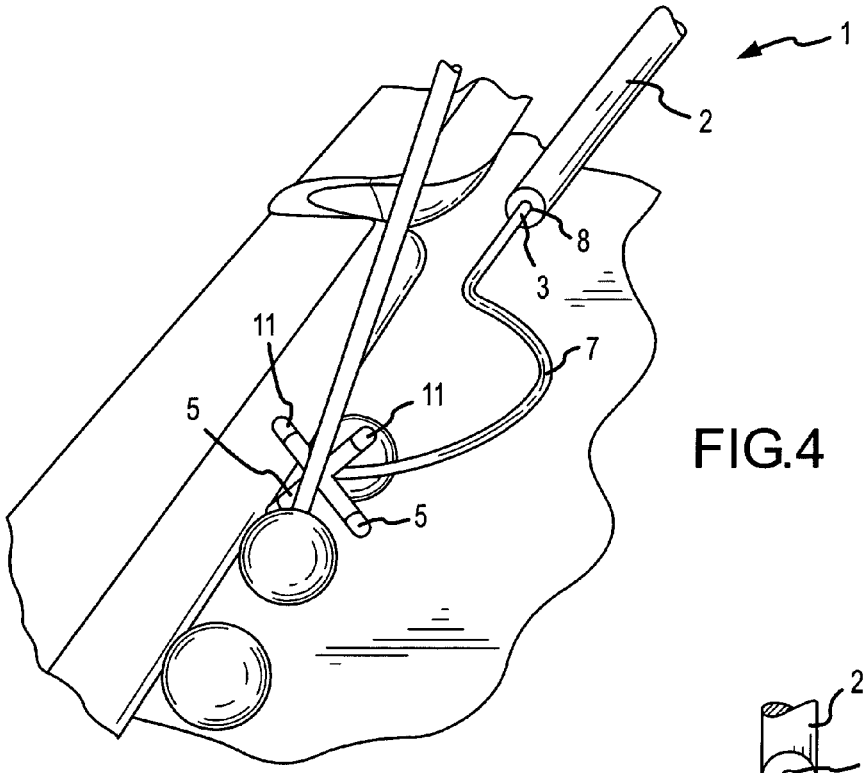
FIG. 4 is another perspective view of a portion of the cue rest of FIG. 1 in use.
Figure 5:
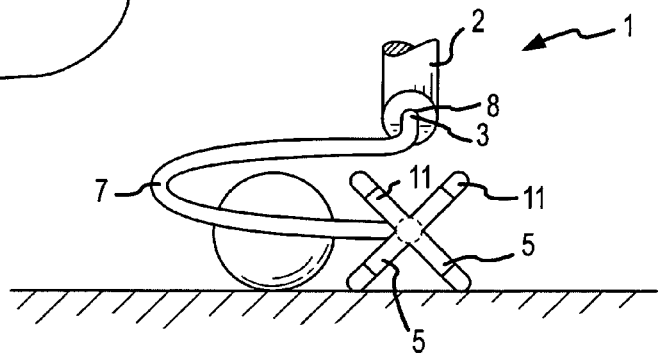
FIG. 5 is an end elevational view of a portion of the cue rest of FIG. 1 in use.

Referring to FIGS. 1–7, there is illustrated a cue rest according to the invention, indicated generally by the reference numeral 1, for cradling a cue in a game of snooker, billiards, or indeed pool, or such other games in which a cue ball is struck by a cue. The cue rest 1 comprises an elongated shaft 2, typically of wood, but may be of any other suitable material, for example, plastics material or the like. The shaft 2 defines a longitudinally extending central axis 4, and a table engaging means, namely, a pair of table engaging members 5 is coupled to the shaft 2 by an intermediate connecting means 7. Referring now to FIGS. 1–7, one embodiment of the the intermediate connecting means 7 is of an intermediate connecting member of arcuate shape. The intermediate connecting member 7 is of brass, and at one end 3 extends into an axial bore 8 in the shaft 2, and is secured therein. The table engaging members 5 are also of brass, and a threaded spigot 9 extending from the table engaging members 5 pivotally engages the intermediate connecting member 7 at the other end 6 thereof, for facilitating pivoting of the table engaging members 5 relative to the intermediate connecting member 7. A wing nut 10 secures the table engaging members 5 to the intermediate connecting member 7 at a desired relative orientation. A cue engaging means, namely, a pair of cue engaging members 11 is integrally formed also of brass with the table engaging members 5 in the form of a cruciform unit. In this embodiment of the invention the interconnecting member 7 is secured to the shaft 2 so that the respective ends 3 and 6 are in alignment with the shaft axis 4, and in particular, the threaded spigot 9 about which the table engaging members 5 and the cue engaging members 11 are pivotally connected to the intermediate connecting member 7 is axially aligned with the shaft axis 4, so that the table engaging members 5 and the cue engaging members 11 are pivotal about the shaft axis 2.

The intermediate connecting member 7 of FIGS. 1–7 is of arcuate shape so that the cue rest 1 may be rested on the table with the table engaging members 5 adjacent the cue ball irrespective of whether the cue ball is obstructed by other balls in play on the table. For example, if one or more balls in play are located adjacent the cue ball to the rear thereof, when one considers the line of sight of the cue ball with the next ball on the table to be played, the table engaging members 5 can be rested on the table immediately behind the cue ball, and the arcuate shape of the intermediate connecting member 7 avoids the ball or balls to the rear of the cue ball. Accordingly, in this way, the cue rest can be rested on the table with the table engaging members 5 adjacent the cue ball, and with the shaft 2 extending substantially parallel to the table without interfering with any of the balls in play, see FIGS. 2, 4, 5 and 7.

Figure 6:
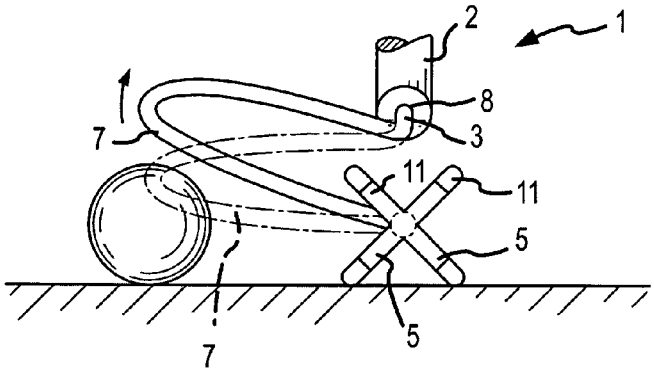
FIG. 6 is another end elevational view of the cue rest of FIG. 1 in use.

Alternatively, the cue rest 1 may be rested on the table with the table engaging members 5 adjacent the cue ball, but with the intermediate connecting member 7 angled relative to the table surface about the shaft axis as illustrated in FIG. 6, so that the connecting member 7 clears the top of an obstructing ball or balls as illustrated in FIG. 6. To use the cue rest 1 with the intermediate connecting member 7 angled as illustrated in FIG. 6, the wing nut 10 is slackened and the spigot 9 is rotated in the intermediate connecting member 7 until the table engaging members 5 and the intermediate connecting member 7 are oriented relative to each other, so that when the table engaging members 5 are rested on the table, the intermediate connecting member 7 is angled about the shaft axis 4 relative to the table surface at the desired angle. When the table engaging members 5 and the intermediate connecting member 7 are oriented relative to each other at the desired angle, the wing nut 10 is tightened, thus securing the table engaging members 5 at the desired orientation relative to the intermediate connecting member 7.

Use of the cue rest of the embodiment illustrated in FIGS. 1–7 thereafter is similar to a conventional cue rest, with the exception that the cue rest 1 can be located with the table engaging members 5 and the cue engaging members 11 located behind and adjacent the cue ball with the intermediate connecting member clearing any obstructing balls in play which are behind the cue ball.

While the intermediate connecting member 7 has been described as being of arcuate shape, the intermediate connecting member may be of any suitable shape, provided it is shaped to avoid obstructions adjacent the cue ball. For example, in certain cases, it is envisaged that the intermediate connecting member 7 may be formed by a pair of spaced apart transverse cross-members extending transversely of the shaft axis, one of which would extend from the shaft, and the other from the table engaging member, and the respective transverse cross-members would be joined by a longitudinally extending member which would extend parallel to the shaft axis but spaced apart therefrom.

Figure 8:
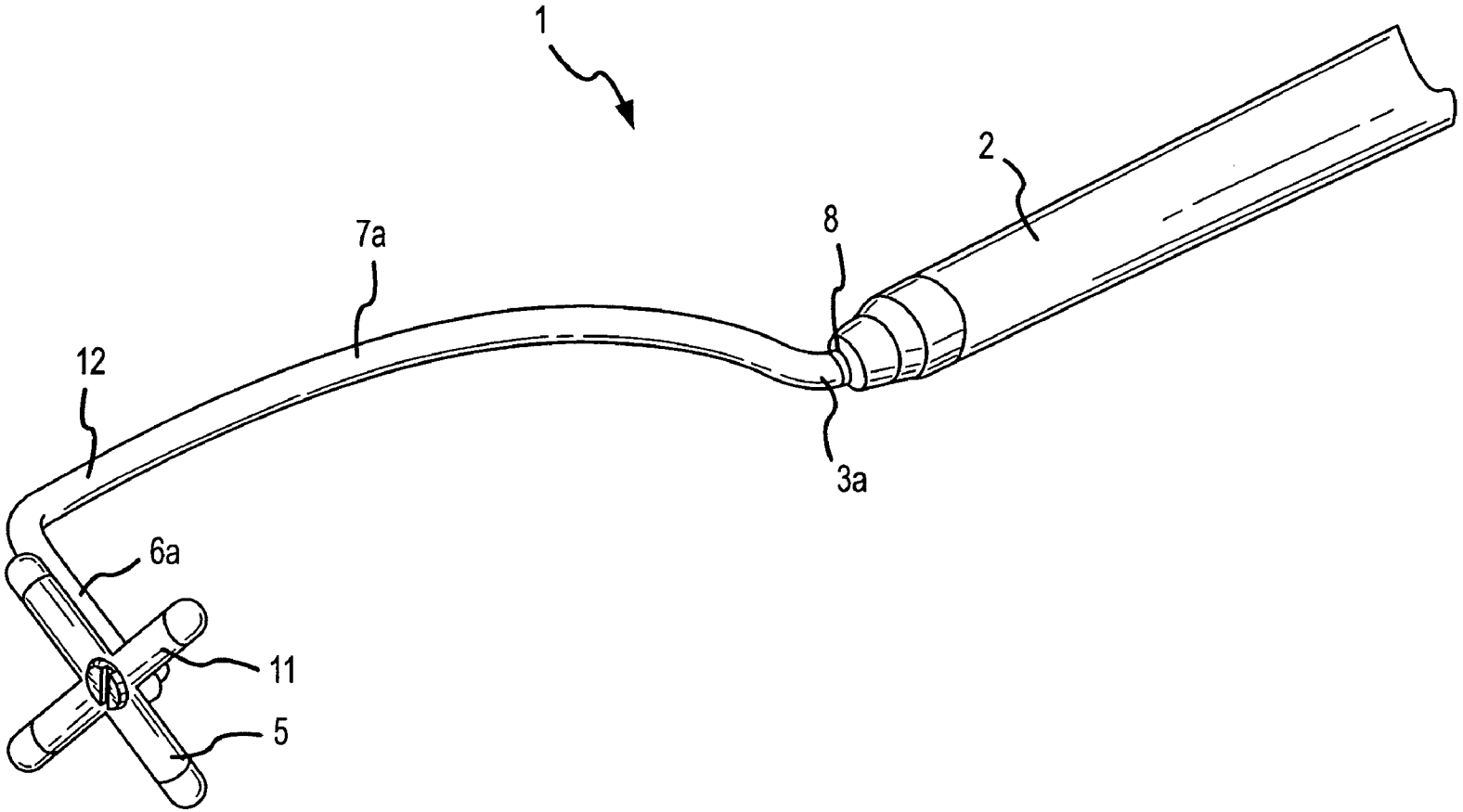
FIG. 8 is a perspective view of an alternative embodiment of a cue rest according to the invention.
Figure 9:
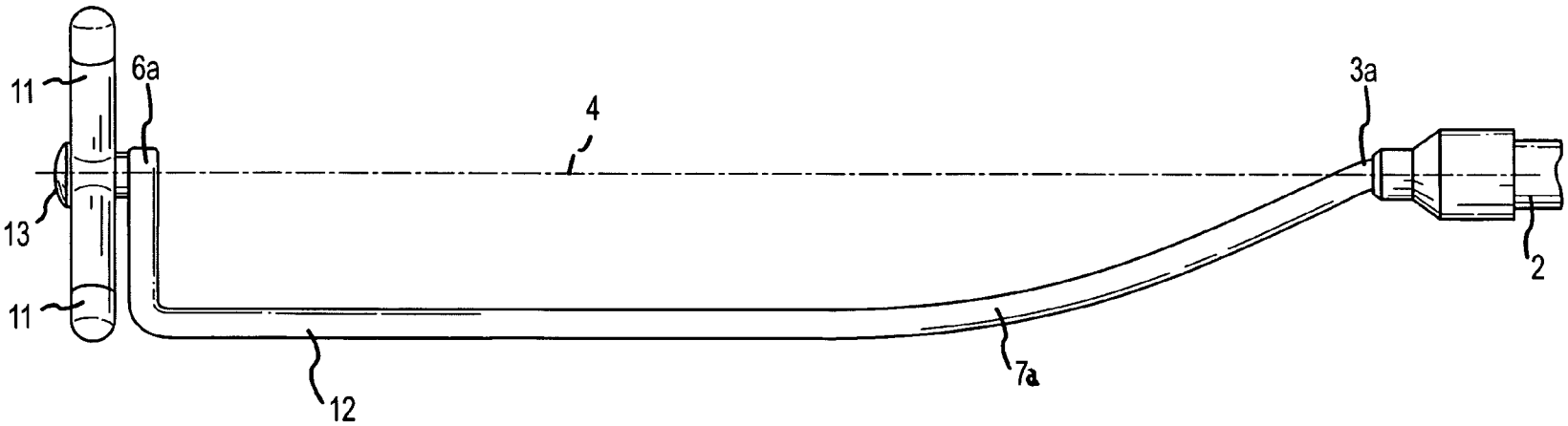
FIG. 9 is a perspective view of a portion of the the cue rest of FIG. 8.

With reference to FIGS. 8 and 9, an alternative embodiment of the present invention is described. The intermediate connecting means is an intermediate connecting member 7*a* of half-bottle shape.

By half-bottle shape we mean the shape of a typical Bordeaux wine bottle silhouette, halved along its central longitudinal axis. The term 'half-bottle shape' as applied to the embodiment of FIGS. 8 and 9 therefore defines a short horizontal portion (6*a*) set substantially perpendicular to a longer vertical median portion (12), with the vertical median portion extending into a curved portion which terminates in a straight line set substantially parallel with the vertical median portion, that lies along the axis of a perpendicular line 4 at the other end of the horizontal portion.

The intermediate connecting member 7*a* has one end 3*a* connected to the shaft 2 and the other end 6*a* connecting with the table engaging members 5 and median vertical portion 12 between them. One end 3*a* is curved away from shaft axis 4 and is formed continuously with the median portion 12 which is substantially straight and parallel to shaft axis 4. The other end 6*a* of the intermediate member 7*a* is perpendicular to the vertical median portion 12 and shaft axis 4.

This is embodiment permits the user to lay the cue rest along the flat median vertical portion 12 of the intermediate connecting member 7*a*, thereby raising the height of the cue engaging members 11 from the playing surface, providing a greater diversity of use for the invention during play, and therefore obviating the need for numerous cue rests in order to fulfill the player's requirements.

Figure 10:
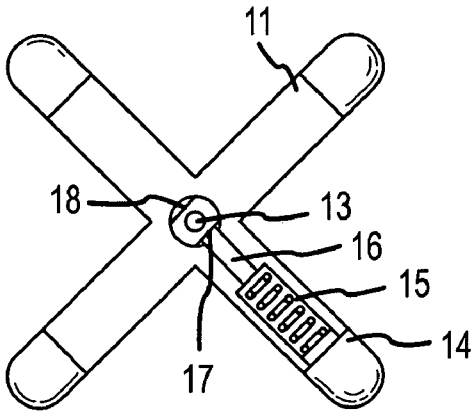
FIG. 10 is a cut away view of a portion of an alternative embodiment of the cue rest of the present invention.

Referring now to FIG. 10, an alternative embodiment of the table engaging member is described. The connecting means between intermediate member and the table engaging member 5 is by means of an axial bolt 13. The table engaging member 5 houses a spring retainer 14 in contact with a compression spring 15. The compression spring 15 is connected to a spindle 16. The spindle 16 in turn contacts the shaft body of the axial bolt 13 by means of the flat end of the spindle 17. The shaft body of the axial bolt 13 is formed with two opposing flat surfaces 18 parallel to the axis of the axial bolt 13.

Thus, axial movement of the spindle 16, by rotation of the table engaging member 5 about shaft axis 4 causes compression of the spring 15. When the flat end 17 of the spindle 16 comes into contact with the flat surface 18 of the shaft body of the axial bolt 13, the relative position of the table engaging member 5 and the intermediate member 7, 7*a* is locked into place. Further rotation of table engaging member 5 about shaft axis 4 allows the process to be reversed. This feature prevents the intermediate table engaging member 7*a* slipping from its desired position during play and striking adjacent balls, (FIG. 6).

Figure 11:
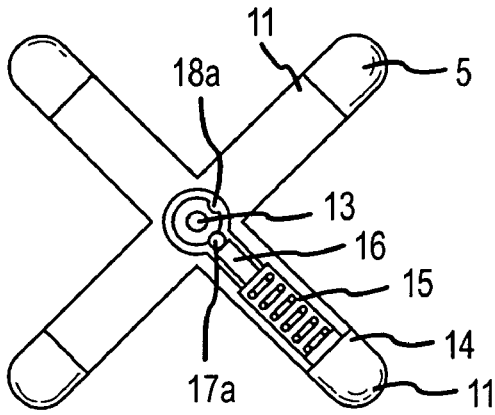
FIG. 11 is a cut away view of a portion of an alternative embodiment of the cue rest of the present invention.

Referring now to FIG. 11, an alternative embodiment of the table engaging means is described. The spindle 16 ends in a spherical cap 17*a* which contacts the shaft body of the axial bolt 13. The shaft of the axial bolt 13 is formed with a hemispherical indentation 18*a* adapted to accommodate the spherical cap 17*a* of the spindle 16.

Figure 12:
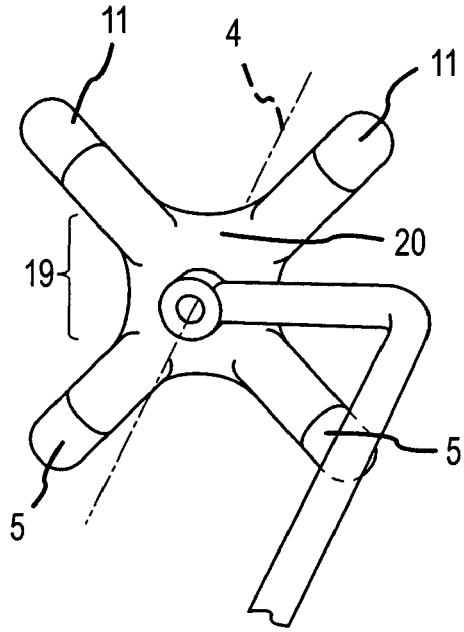
FIG. 12 is a cut away view of a portion of an alternative embodiment of the cue rest of the present invention.
Figure 13:
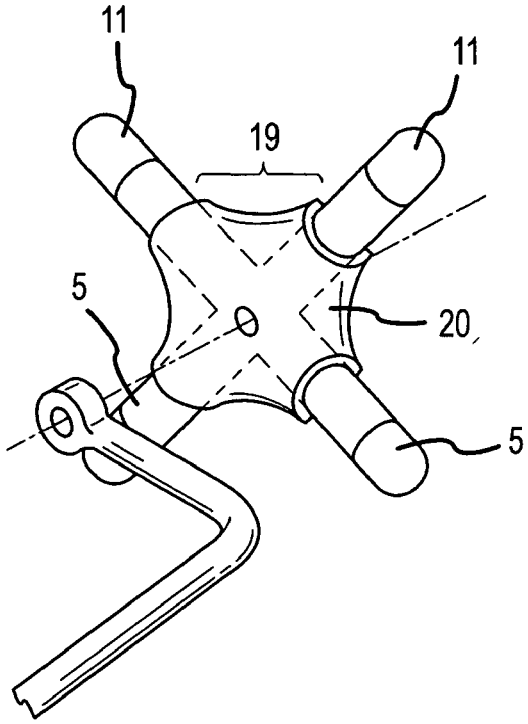
FIG. 13 is a cut away view of a portion of an alternative embodiment of the cue rest of the present invention.

Referring now to FIG. 12 and 13, a further embodiment is described. The cruciform shape of the cue engaging members 11 and table engaging members 5 defines four angles 19. A curved cue support 20 is integrally formed within one of the angles 19. The cue support 20 prevents the cue being engaged by the cue engaging members 11 at the narrowest possible point of contact of the angle 19. It will be appreciated that while the embodiment of FIG. 13 shows a cue support that is detachably mounted by means of engaging between the table engaging means 5 and the intermediate connecting means 7*a*, other embodiments are possible, such as clip on cue supports, for example, wherein the cue support is provided with means to detachably clip onto the cue engaging members. The present embodiment of cue support 20 is illustrated as integrally formed from brass with the cue engaging members 11 and table engaging members 5, however, detachable varieties made of brass, metals, alloys, plastics or the like are also possible.

Furthermore, while various embodiments of the invention may comprise a separate axial bolt 13 to connect the table engaging means to the intermediate connecting member 7, 7*a*, such as by a threaded spigot 9, other variants are possible, for example, in which the axial bolt 13 is integrally formed from the end 6, 6*a* of the intermediate connecting member 7, 7*a*.

While the table and cue engaging members and the intermediate connecting member have been described as being of brass material, they may be of any other suitable material, for example, other metals, alloys, plastics material or the like. In one embodiment, the intermediate connecting member is bendable.

Other methods to secure the intermediate connecting member 7, 7*a* to the table engaging members 5 are possible. For example, it is envisaged that a friction connection may be provided between the table engaging member and the intermediate connecting member for facilitating selective orientation of the table engaging member relative to the intermediate connecting member. Another alternative securing means which is envisaged is a securing means which would permit incremental pivoting of the table engaging member relative to the intermediate connecting member, and the table engaging member would be releasably secured by a quick release mechanism to the intermediate connecting member in each selected incremental position. Needless to say, any other suitable securing means may be provided.

The invention is not limited to the embodiment hereinbefore described, which may be varied in construction and detail.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable subcombination.

The words "comprises/comprising" and the words "having/including" when used herein with reference to the present invention are used to specify the presence of stated features, integers, steps or components but does not preclude the presence or addition of one or more other features, integers, steps, components or groups thereof.

From the foregoing, it will be apparent that numerous modifications and variations can be effected without departing from the true spirit and scope of the novel concept of the present invention. It will be appreciated that the present disclosure is intended to set forth the exemplifications of the invention which are not intended to limit the invention to the specific embodiments illustrated. The disclosure is intended to cover by the appended claims all such modifications as fall within the scope of the claims.

The invention claimed is:

1. A cue rest comprising an elongated shaft defining a central longitudinally extending shaft axis, a table engaging member, and a single intermediate connecting member connecting the table engaging member with the shaft, the intermediate connecting member having a non-linear portion being shaped for avoiding an obstruction on the table located substantially along the shaft axis between the table engaging means and the elongated shaft by being offset from the shaft axis between a location where the table engaging means is to engage the table and a location where the intermediate connecting means connects to the elongated shaft.

2. A cue rest as claimed in claim 1 wherein the intermediate connecting member extends between two spaced apart ends, one end being connected to the shaft, and the other end being connected to the table engaging member.

3. A cue rest as claimed in claim 2 wherein the two ends of the intermediate connecting member are aligned with each other and with the shaft axis.

4. A cue rest as claimed in claim 3 wherein the intermediate connecting member comprises an elongated intermediate connecting member extending between the shaft and the table engaging member.

5. A cue rest as claimed in claim 4 further comprising a cue engaging means for cradling a cue.

6. A cue rest as claimed in claim 1 wherein the intermediate connecting member is formed by a pair of spaced apart transverse cross members, one of which extends from the shaft and the other extending from the table engaging member, and the respective transverse cross members are joined by a longitudinally extending median portion which extends parallel to the shaft axis but spaced apart therefrom.

7. A cue rest as claimed in claim 6 wherein the intermediate connecting member is substantially of half-bottle shape.

8. A cue rest as claimed in claim 1 wherein the table engaging member is adjustably mounted to the intermediate connecting member.

9. A cue rest as claimed in claim 1 provided with a rotational restraining member to restrain the rotational movement of table engaging member relative to the intermediate connecting member.

10. A cue rest as claimed in claim 1 wherein the table engaging member comprises two arms and the cue engaging member comprises two arms which are arranged to form a cruciform structure, the arms defining angles therebetween.

11. A cue rest as claimed in claim 10 wherein at least one of the table engaging member or cue engaging member houses a rotation restraining member.

12. A cue rest as claimed in claim 1 wherein the intermediate connecting member is connectable to the table engaging members by an axial bolt which is adapted for engaging with the rotation restraining member.

13. A cue rest as claimed in claim 12 wherein the axial bolt is integrally formed with at least one of the group consisting of the intermediate connecting member, the table engaging member or the cue engaging member.

14. A cue rest as claimed in claim 6 wherein at least one of the cross members is curved.

15. A cue rest as claimed in claim 14 wherein the intermediate connecting member is of accurate shape.

16. A cue rest as claimed in claim 15 wherein the table engaging member is pivotally connected to the intermediate connecting member.

17. A cue rest as claimed in claim 15 wherein the table engaging member is pivotable about the shaft axis.

18. A cue rest as claimed in claim 6 wherein at least one of the cross members is substantially perpendicular to the shaft axis.

19. A cue rest as claimed in claim 1 wherein a cue engaging member for cradling a cue extends from the table engaging member.

20. A cue rest as claimed in claim 8 having a member for securing the table engaging member to the intermediate connecting member at a desired relative orientation.

21. A cue rest as claimed in claim 1 wherein the intermediate connecting member is bendable.

22. A cue rest comprising an elongated shaft defining a central longitudinally extending shaft axis, a table engaging means, and an intermediate connecting means connecting the table engaging means with the shaft, the intermediate connecting means having a curved portion offset from the central longitudinally extending axis for avoiding an obstruction on the table between a location where the table engaging means is to engage the table and a location where the intermediate connecting member connects to the elongated shaft.

* * * * *